US005136728A

United States Patent [19]

Kamata

[11] Patent Number: 5,136,728

[45] Date of Patent: Aug. 11, 1992

[54] JET TYPE HELMET

[75] Inventor: Eitaro Kamata, Tokyo, Japan

[73] Assignee: Shoei Kako Kabushiki Kaisha, Japan

[21] Appl. No.: 623,624

[22] Filed: Dec. 6, 1990

[30] Foreign Application Priority Data

Aug. 20, 1990 [JP] Japan ..... 2-218564

[51] Int. Cl.[5] ..... A42B 1/08

[52] U.S. Cl. ..... 2/424; 2/171.3

[58] Field of Search ..... 2/171.3, 184.5, 410, 2/411, 424, 425

[56] References Cited

U.S. PATENT DOCUMENTS

| | | | |
|---|---|---|---|
| 4,115,874 | 9/1978 | Hasegawa | 2/425 |
| 4,514,864 | 5/1985 | Huber | 2/424 |
| 4,538,303 | 9/1985 | Schnitzler | 2/424 |
| 4,698,856 | 10/1987 | Arai | 2/425 |
| 4,700,411 | 10/1987 | Kawasaki et al. | 2/425 |

FOREIGN PATENT DOCUMENTS

| | | | |
|---|---|---|---|
| 135812 | 8/1984 | European Pat. Off. | 2/424 |
| 268549 | 5/1988 | European Pat. Off. | 2/410 |
| 2498060 | 7/1982 | France | 2/424 |
| 63-94924 | 6/1988 | Japan . | |
| 2198925 | 6/1988 | United Kingdom | 2/424 |

*Primary Examiner*—Werner H. Schroeder
*Assistant Examiner*—Michael A. Neas
*Attorney, Agent, or Firm*—Armstrong, Nikaido, Marmelstein, Kubovcik & Murray

[57] ABSTRACT

A jet type helmet including a cap body and a shield plate supported on the cap body at opposite sidewalls for opening and closing a window. An air intake is provided in a front wall of the cap body above the window for introducing air from a forward direction into the cap body when the shield plate is at its closed position in which the shield plate covers the window. The helmet further includes a diffuser disposed at an edge portion of the window to be communicated with the air intake hole and directing its opening toward an inner surface of the shield plate when in a closed position. Even when a wearer of the helmet is in a stooped position at the time of travelling, a cloud on the inner surface of the shield plate can be eliminated by introducing an air flow.

3 Claims, 9 Drawing Sheets

JET TYPE HELMET

BACKGROUND OF THE INVENTION

1. Field of the Invention

The present invention relates to a jet type helmet in which a shield plate is supported on both sidewalls of a cap body for opening and closing a window, and an air intake hole is provided in a front wall of the cap body above the window to introduce air from a forward direction into the cap body when the shield plate is in its closed position.

2. Description of the Prior Art

There is conventionally known a jet type helmet of the above type, for example, as disclosed in Japanese Utility Model Laid-Open No. 63-94924 (94924/88).

When a wearer of the jet type helmet travelling on a motorcycle is in a stooped position with the shield plate of the helmet at its closed position in which the shield plate covers the window, it is difficult to introduce a travelling wind inside the shield plate, and the wearer's breath touches an inner surface of the shield plate to cloud up the same.

SUMMARY OF THE INVENTION

The present invention has been accomplished in consideration with these circumstances. It is an object of the present invention to provide a jet type helmet which eliminates a cloud on a shield plate at the closed position.

According to the present invention, a diffuser, opened toward an inner surface of a shield plate in its closed position and communicated with an air intake hole, is disposed at an edge of a window.

With such a construction, the air introduced from an air intake hole into a cap body is spouted out from the diffuser so as to be directed forward. Thus, when a wearer of the helmet is in a stooped position with the shield plate closed, the spouted air is fed downwardly along the inner surface of the shield plate, and the downward air flow is promoted by a negative air pressure generated in the lower portion of the shield plate, thereby eliminating a cloud on the shield plate.

These and other objects and features of the present invention will become apparent from the following detailed description in conjunction with the attached drawings.

BRIEF DESCRIPTION OF THE DRAWINGS

The figures illustrate one embodiment of the present invention, wherein.

DESCRIPTION OF THE PREFERRED EMBODIMENT

Figure 1:
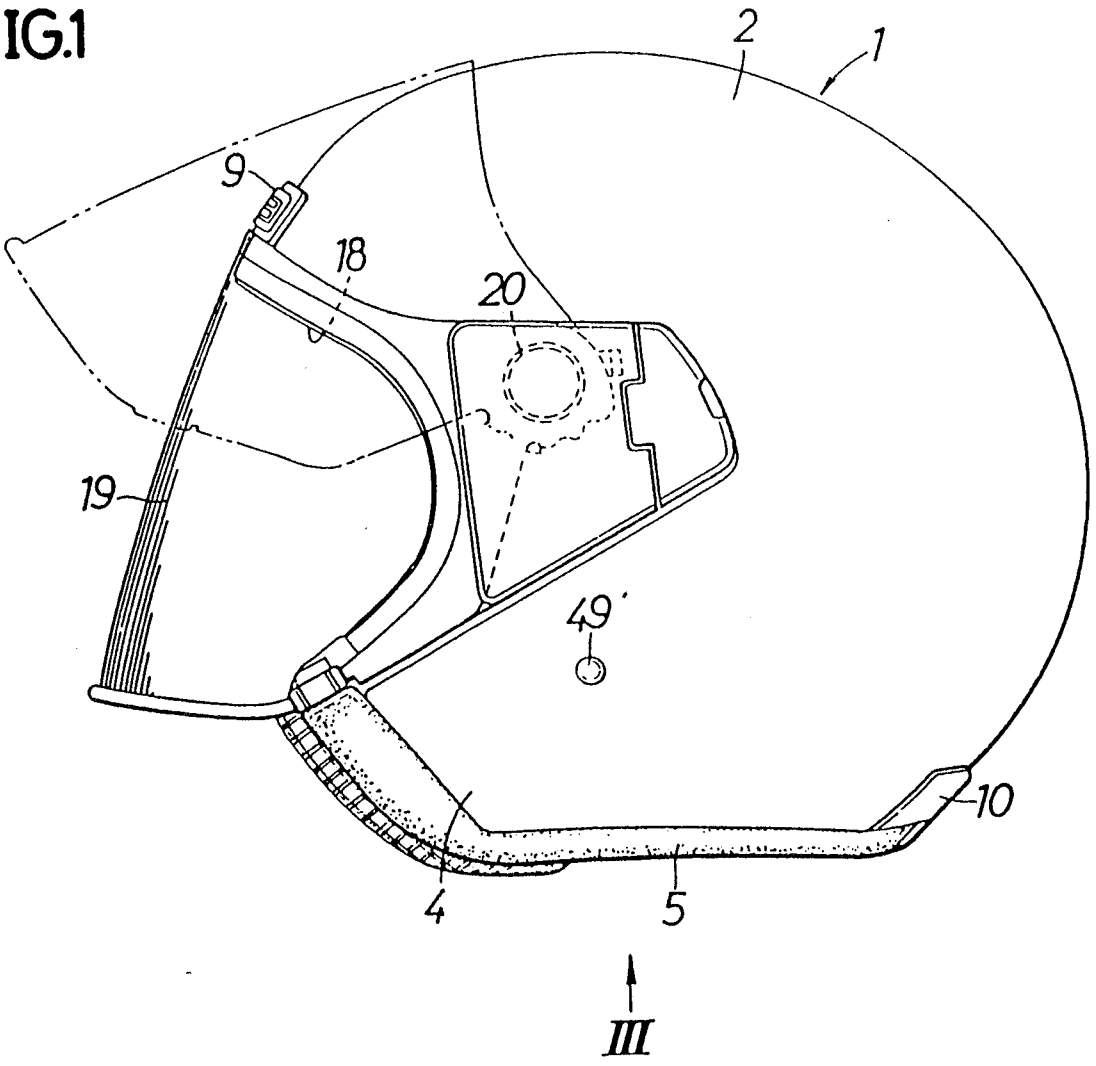
FIG. 1 is a side view of a helmet according to the present invention.
Figure 2:
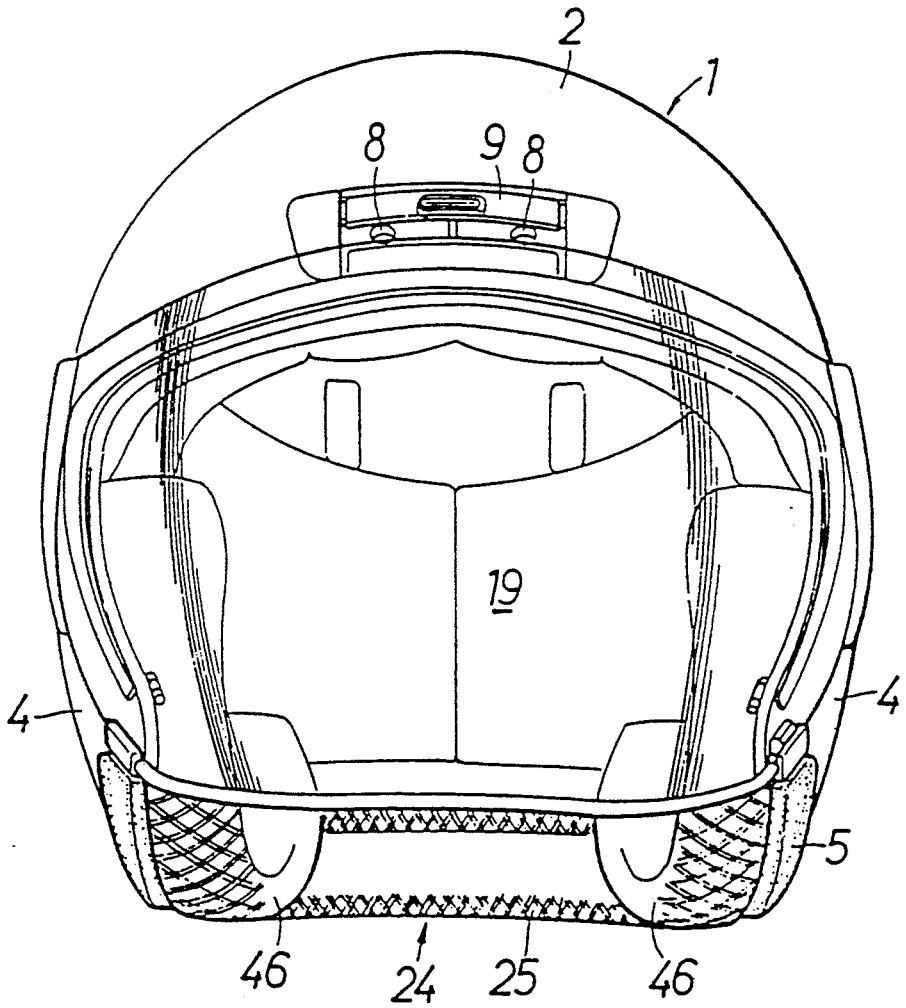
FIG. 2 is a front view of the helmet.
Figure 3:
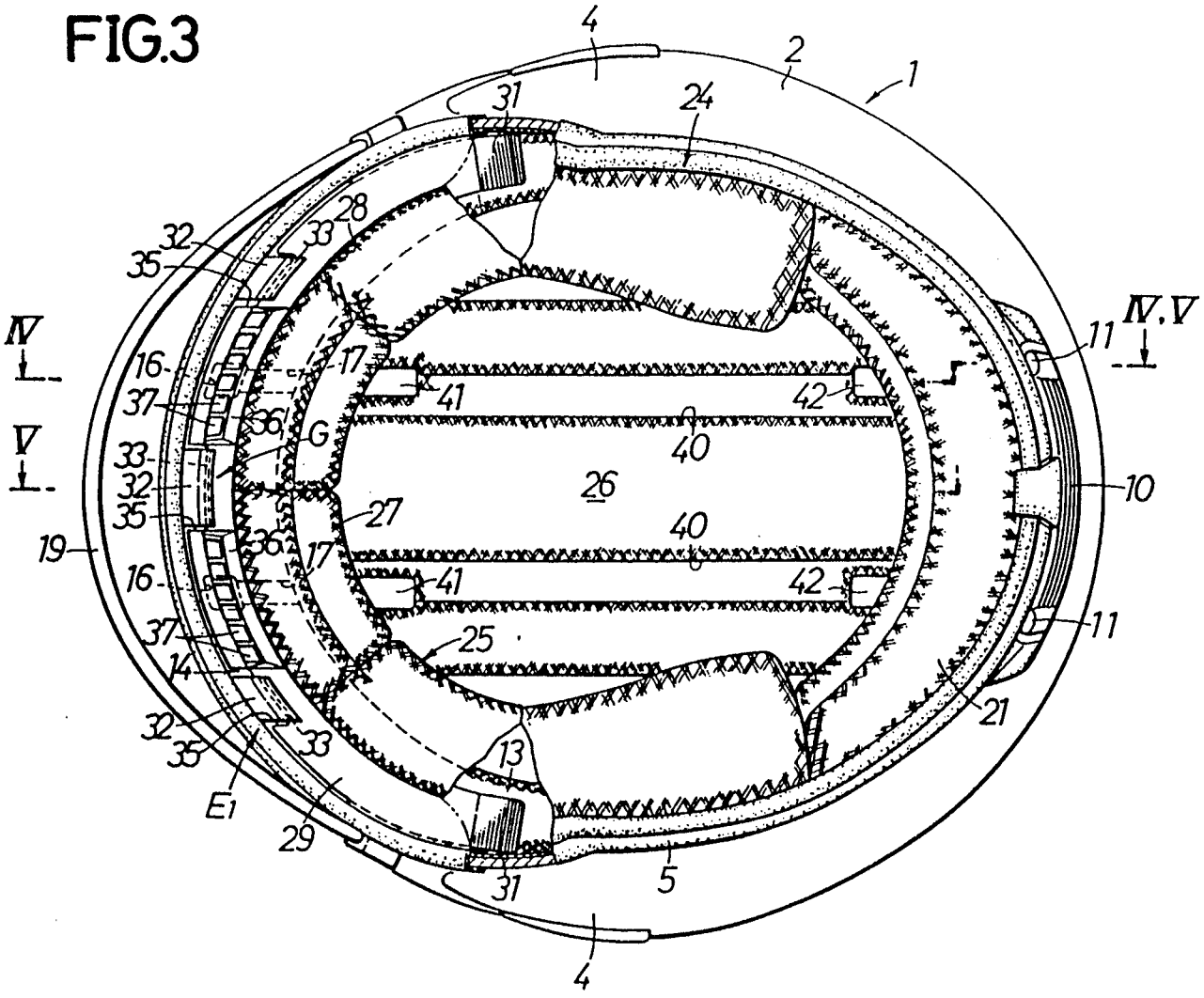
FIG. 3 is an enlarged bottom view as seen from an arrow III in FIG. 1.
Figure 4:
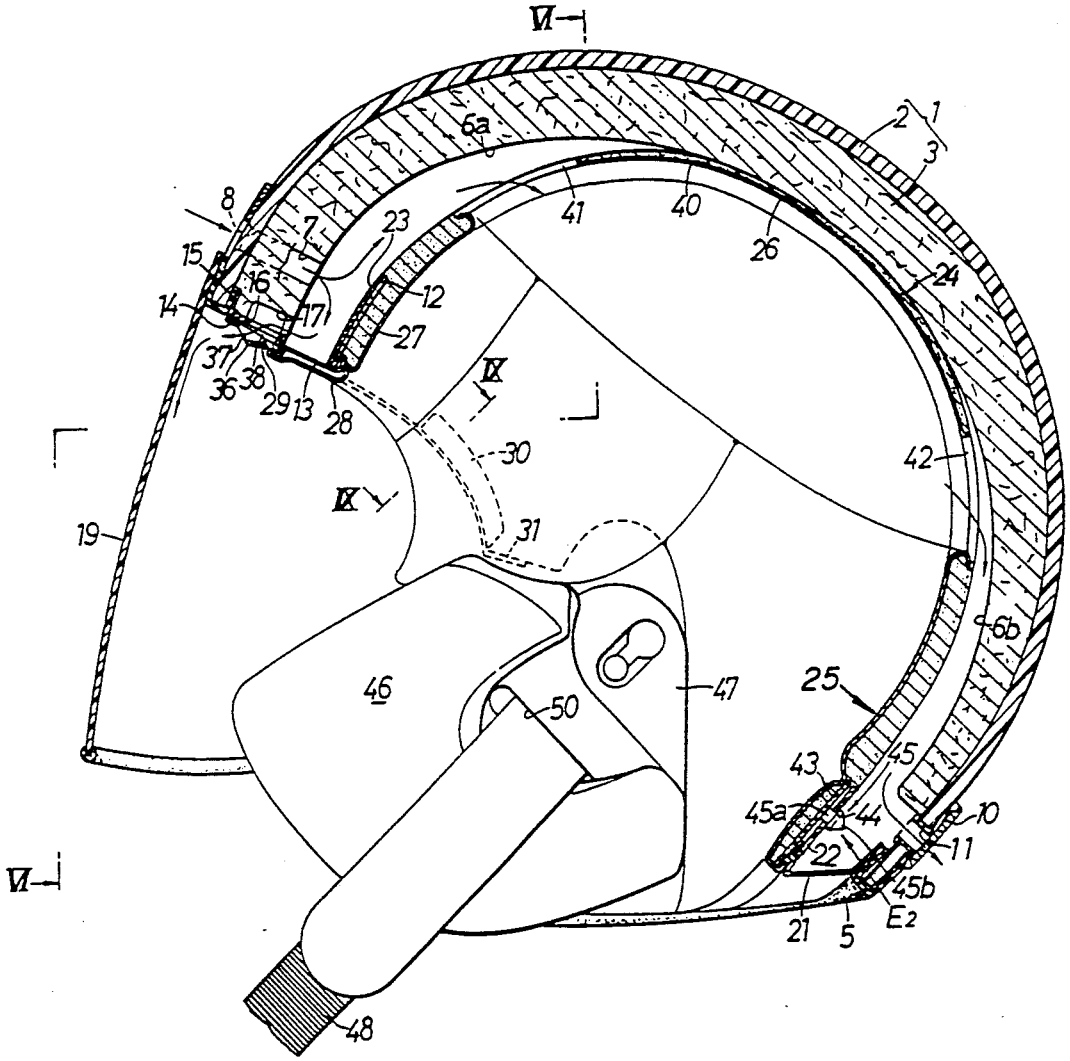
FIG. 4 is a sectional view taken along the line IV—IV in FIG. 3.
Figure 5:
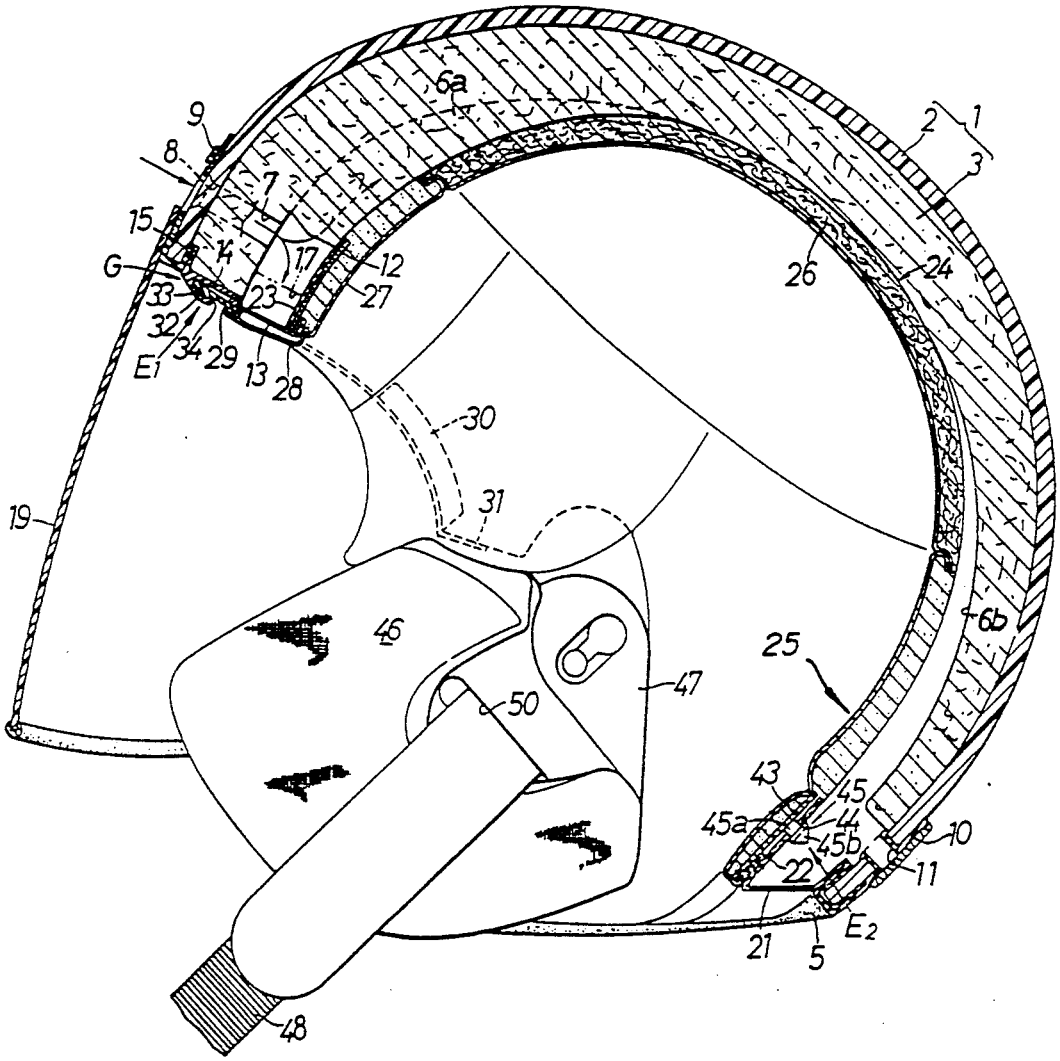
FIG. 5 is a sectional view taken along the line V—V in FIG. 3.
Figure 6:
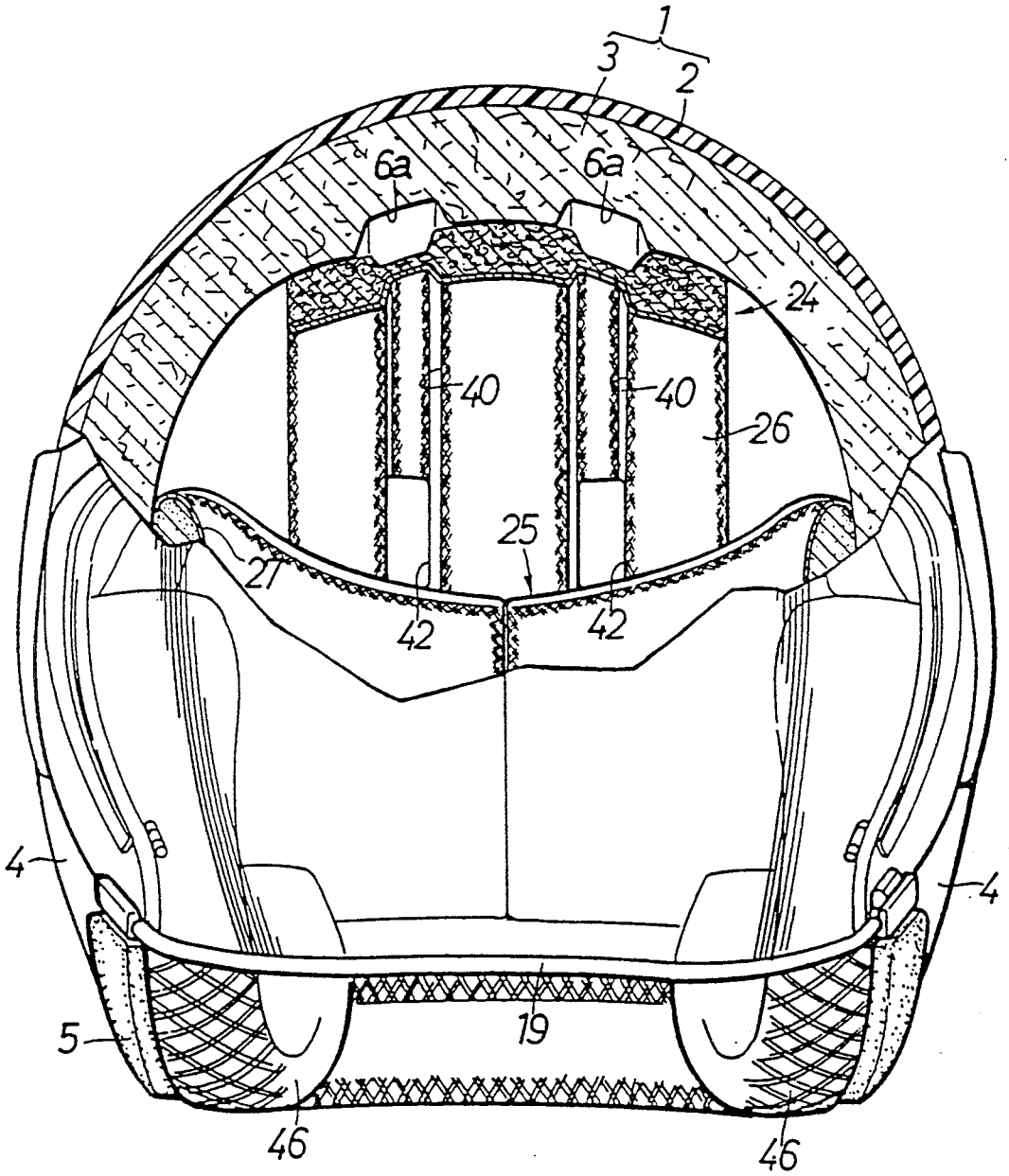
FIG. 6 is a sectional view taken along the line VI—VI in FIG. 4.

The present invention will now be described by way of embodiment with reference to the accompanying drawings.

Referring first to FIGS. 1 to 6, this helmet is a jet type helmet, a cap body 1 of the helmet comprises a shell 2, made of hard high strength resin, which forms an outer shell and a buffer liner 3 made of foamed styrol which is fitted into the shell 2. A pair of left and right ear cover portions 4 are integrally formed with the shell 2 and extend downward for covering the peripheries of ears of a wearer of the helmet. An edge member 5 made of rubber is adhesively fitted on a lower edge of the shell 2. The buffer liner 3 is adhesively fitted in the shell 2 excluding both the ear cover portions 4.

A shield plate 19 made of transparent synthetic resin, 1 for opening or closing a window 18 which is defined in a front of the cap body 1, is supported at its opposite ends on the cap body 1 on both sides of the window 18 through pivot sections 20. The shield plate 19 is turnable between a closed position indicated by a solid line in FIG. 1 and an opened position indicated by a dotted broken line in FIG. 1.

Two front ventilation grooves **6*a* extend longitudinally of the cap body 1. The grooves 6*a* are formed in a front inner surface of the buffer liner 3 near a lateral center line thereof. Two rear ventilation grooves 6*b* extending longitudinally and correspond to the front ventilation grooves 6*a*. The grooves 6*b* are formed in the rear inner surface of the buffer liner 3. The ventilation grooves 6*a* and 6*b* are formed so as to become shallower in depth as they approach the top or summit of the inner surface of the buffer liner 3 so that the grooves 6*a* and 6*b* become flush with the inner surface of the buffer liner 3 at the top of the inner surface of the buffer liner 3. The front ends of the front ventilation grooves 6*a* communicate with a pair of vent holes 7 perforated in the buffer liner 3, respectively, and the vent holes 7 communicate with a pair of air intake holes 8 formed in the front portion of the shell 2, respectively. A slide type opening/closing cover 9 is attached to the outer surface of the front portion of the shell 2 to open or close the air intake holes 8. A louver-like cover portion 10 has a plurality of projections extending horizontally at vertical intervals therebetween. The cover portion 10 is integrally formed on the edge member, 5 which is on the lower edge of the shell 2, at a position corresponding to the lower end of the rear portion of the cap body 1 so as to cover the outer surface of the lower end of the rear portion of the shell 2. Two air discharge holes 11, communicating with the rear ventilation grooves 6*b* of the buffer liner 3, are formed in the cover portion 10. Accordingly, when a wearer of the helmet is travelling on a motorcycle, air streams are generated in the rear ventilation grooves 6*b* toward air discharge holes 11 by a negative air pressure generated in the air discharge holes 11**.

Figure 7:
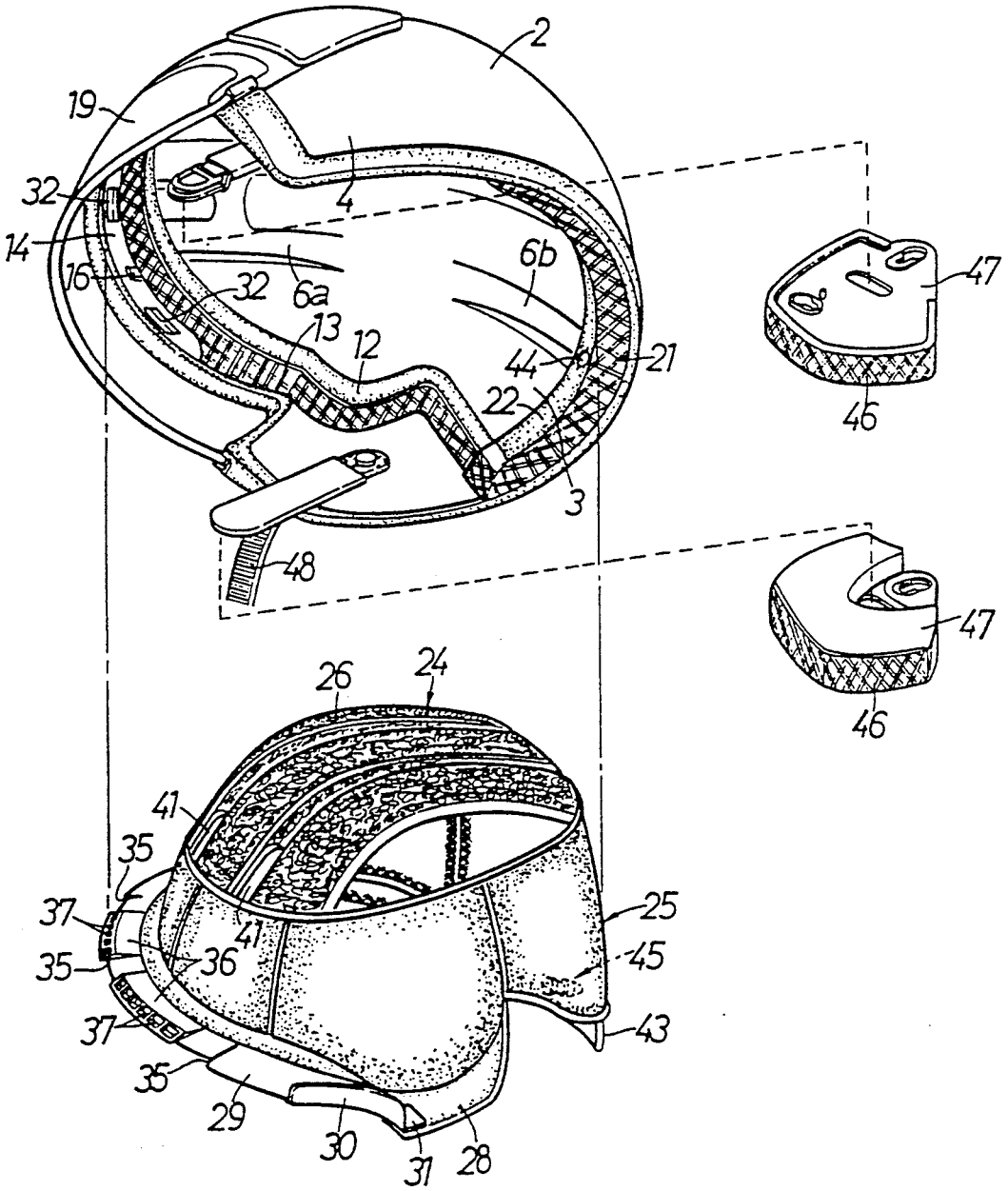
FIG. 7 is an exploded perspective view of a cap body and an inner fitted pad.
Figure 8:
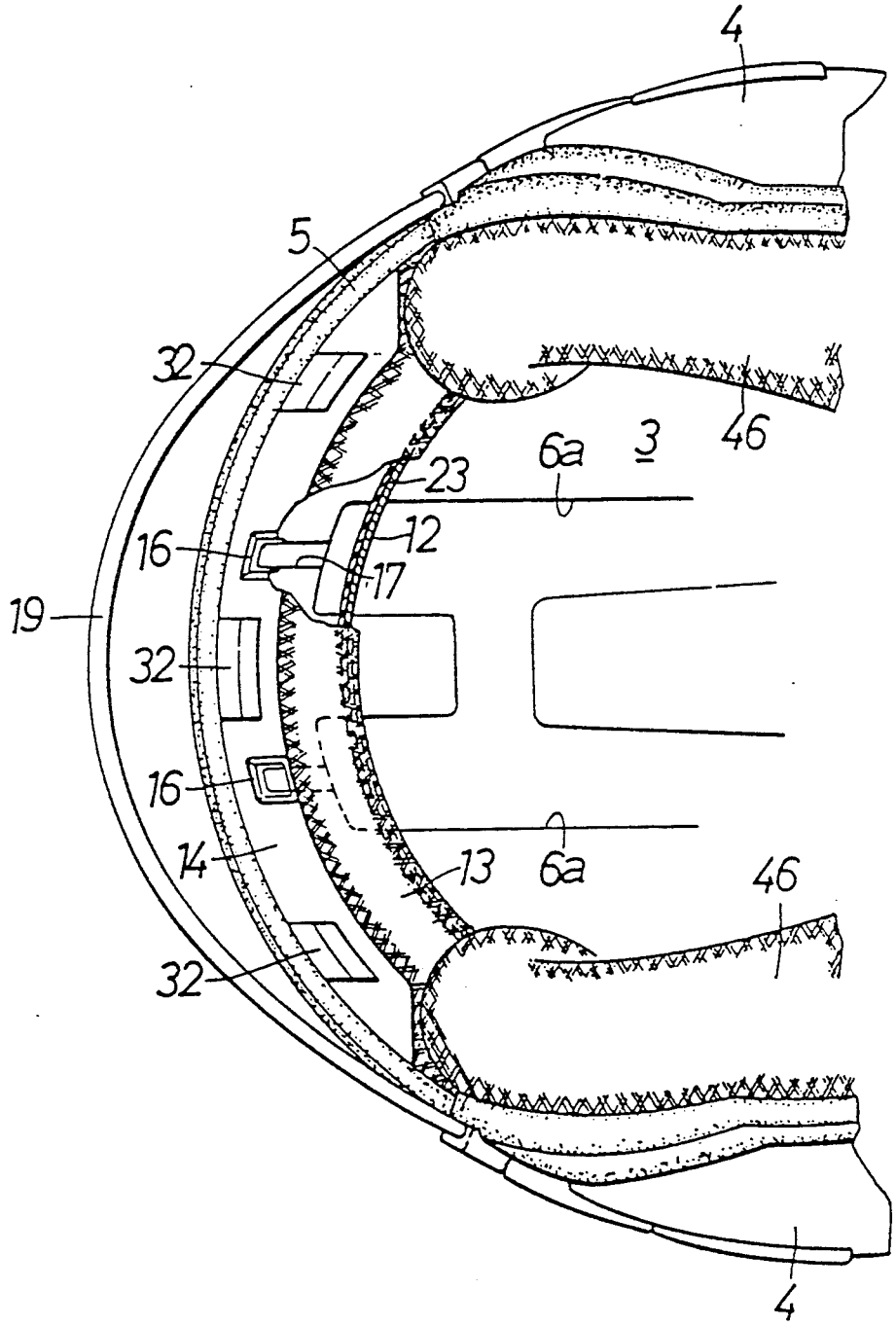
FIG. 8 is a front bottom view of the helmet in a state that the inner fitted pad is removed.
Figure 9:
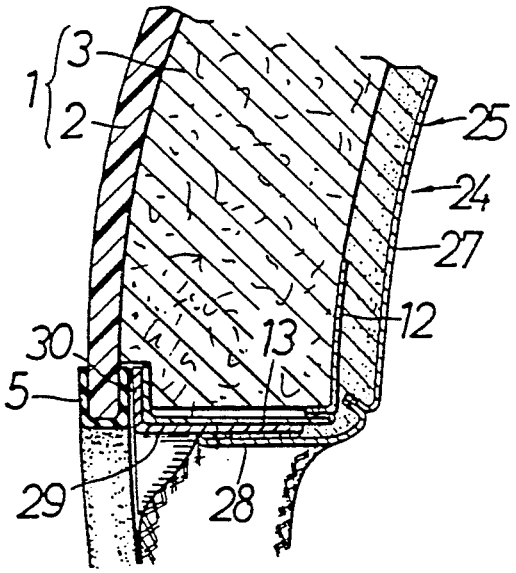
FIG. 9 is a sectional view taken along the line IX—IX in FIG. 4.

Referring also to FIGS. 7 to 9, a supporting sheet 12, made of flexible synthetic resin, is adhered to the inner surface of the lower end of the buffer liner 3 excluding its rear portion. A cover plate 23, made of synthetic resin having a suitable rigidity, is adhered to the supporting sheet 12 at portions corresponding to the front ends of both front ventilation grooves **6*a*, thereby avoiding entry of the supporting sheet 12 together with an inner pad 24, to be described later, into both the front ventilation grooves 6a. A supporting cloth 13, knitted to have relatively big stitches in order to have air permeability, is sewed to the supporting sheet 12. A first supporting plate 14, covering the lower end face of the front portion of the buffer liner 3, is sewed to the supporting cloth 13. The first supporting plate 14 is formed of synthetic resin having relatively high rigidity, and formed in a circular arc shape corresponding to the lower end face of the front portion of the buffer liner 3 having a substantially L-shaped cross section so as to form an insertion portion 15 to be inserted between the buffer liner 3 and the shell 2. The peripheral edge of the supporting cloth 13, excluding the first supporting plate 14, is adhered to the outer surface of the buffer liner 3 to be held between the shell 2 and hence, the liner 3, and the supporting cloth 13 covers the faces corresponding to the end front portion and both side portions of the buffer liner 3. A pair of communication holes 16 are formed in the first supporting plate 14 to communicate with the front ends of the front ventilation grooves 6a via a communication groove 17 which is formed on the lower end face of the front portion of the buffer liner 3**.

An end of a supporting cloth 21, for covering a lower end face of a rear portion of the buffer liner 3 is adhered to an outer surface of the buffer liner 3 at a lower end of the rear portion of the cap body 1 to be held between the shell 2 and the liner 3. A second supporting plate 22, for covering an inner surface of the lower end of the rear portion of the buffer liner 3, is sewed to the supporting cloth 21. The supporting cloth 21 is knitted with relatively big stitches, and the second supporting plate 22 is formed of synthetic resin having relatively high rigidity.

An inner pad 24 is detachably disposed inside the buffer line 3 in the cap body 1. The inner pad 24 comprises a side pad 25 fundamentally formed in a loop shape to be brought into contact with a side portion of the wearer's head, and a ceiling pad 26 formed integrally with the side pad 25 and brought into contact with a top portion of the wearer's head.

The entire surface of the side pad 25 is covered with a cloth cover 27 having air permeability. A cover extension portion 28, for covering the lower end face of the buffer liner 3 at the front portion and opposite sides of the cap body 1, is extended from the cover 27. A first mounting plate 29, to be detachably engaged with the first supporting plate 14, is sewed to the cover extension portion 28. This first mounting plate 29 is formed in a circular arc shape corresponding to the lower end face of the front portion of the buffer liner 3 and is made of synthetic resin having relatively, high rigidity, and is opposed to the first supporting plate 14. A pair of insertion portions 30, to be inserted between the buffer liner 3 and the shell 2, are formed at the front ends of the first mounting plate 29 closer to both peripheral ends thereof. Holding portions 31, to be held between ear pads 46 (which are to be described later) and the buffer liner 3, are provided at opposite peripheral ends of the first mounting plate 29.

Guide means G guides a longitudinal sliding movement of the first mounting plate 29 between an engaging position and a separating position for defining a predetermined mounting position of the first mounting plate 29 with respective to the first supporting plate 14. A first locking means $E_1$ detachably engages the first mounting plate 29 with the first supporting plate 14. The guide means 6 and first locking means $E_1$ are provided at the first mounting plate 29 and the first supporting plate 14.

The guide means G has three engaging portions 32 provided at a peripheral interval on the first supporting plate 14. Three recesses 35, provided on the first mounting plate 29, correspond to the engaging portions 32. Each of the engaging portions 32 is elongated from the front end of the first supporting plate 14 rearwardly by cutting and bending a portion of the first supporting plate 14 downwardly from its lower surface. Each of the recesses 35 is formed by notching the front end of the first mounting plate 29 to be followed by the corresponding engaging portion 32. The first mounting plate 29 can be guided at a predetermined mounting position between the insertion of position and the separating position by engaging the engaging portions 32 in the recesses 35, respectively.

The locking means $E_1$ comprises pawls 34 respectively provided on upper surfaces of rear ends of the engaging portions 32. Locking projections 33, projected on lower surfaces of front ends of the recesses 35, are to be engaged with the pawls 34.

The locking projections 33 of the first locking means $E_1$ are urged to engage elastically with the corresponding pawls 34 by sliding the first mounting plate 29 from the rear separating position to the front engaging position on the first supporting plate 14 while defining the first mounting plate 29 in a predetermined mounting position by means of the guide means G. When the first mounting plate 29 is rearwardly from its locked state, the elastically engagement of the locking projections 33 with the pawls 34 are released, and the first mounting plate 29 is detached from the first supporting plate 14.

Box-shaped protrusions 36 are formed on the lower surface of the first mounting plate 29 between the recesses 35. The protrusions 36 protrude downward with their protruded amounts increasing in a forward direction. A plurality of diffusers or openings 37 are formed on the front ends of the protrusions 36, respectively, to open forwardly so that they are directed to the inner surface of the shield plate 19 at its closed position. Passages 38, communicating with the communication holes 16 provided in the first supporting plate 14, are formed between the protrusions 36 and the first supporting plate 14 in a state where the first mounting plate 29 is engaged with the first supporting plate 14. The diffusers 37 communicate with the front ends of the front ventilation grooves 6a through the passages 38, the communication holes 16 and the communication grooves 17.

The ceiling pad 26 is formed in a belt shape. The pad 26 has free ends at both left and right ends, and front and rear ends sewed to the front and rear ends of the side pad 25. An inner surface of the ceiling pad 26 is provided with a pair of ventilation grooves 40 corresponding to the pair of front ventilation grooves 6a and the pair of rear ventilation grooves 6b on the inner surface of the buffer liner 3, and also provided with a pair of guide holes 41 for communicating both ventilation grooves 40 with the front ventilation grooves 6a, and a pair of guide holes 42 for communicating both ventilation grooves 40 with the rear ventilation grooves 6b when the inner pad 24 is mounted in the cap body 1. If negative air pressure is generated in the air discharge holes 11 when the wearer of the helmet is travelling on a motorcycle, an air stream is generated and directed toward the rear ventilation grooves 6b through the front ventilation grooves 6a, both guide holes 41, both ventilation grooves 40 and both guide holes 42.

A second mounting plate 43, opposed to the second supporting plate 22, is sewed to the rear end of the side pad 25 of the inner pad 24. The second mounting plate 43 is formed of synthetic resin having relatively high rigidity. The second supporting plate 22 and the second mounting plate 43 are detachably engaged through second locking means $E_2$. The second locking means $E_2$ has a pair of engaging holes 44 provided at a peripheral interval in the second supporting plate 22, and a pair of engaging projections 45 projecting on the second mounting plate 43 to be elastically engaged with the respective engaging holes 44.

Each of both the engaging projections 45 is comprised of a shaft 45a and an enlarged locking projection 45b which is connected to a tip end of the shaft 45a via a step and is formed tapered so as to have a gradually reduced free end and the maximum outer diameter of the enlarged locking portion 45b is larger than the inner diameter of the engaging hole 44. The engaging projections 45 are elastically engaged with the engaging holes 44 by pressing the enlarged locking portions 45b into the engaging holes 44.

Ear pads 46, for receiving wearer's ears, are detachably mounted on an inner surfaces of the ear covers 4, respectively. The ear pads 46 are formed in a C-shaped to form recesses between the lower end of the buffer liner 3 and the pads 46 for receiving the wearer's ears, and are fixed to the inner surfaces of supporting plates 47, made of synthetic resin having relatively high rigidity. The supporting plates 47 are detachably engaged with the ear covers 4, respectively.

A pair of chin straps 48 are fixed at one end thereof to the ear covers 4 through rivets 49 and are capable of fastening to each other so as to secure the cap body 1 to the head of the wearer of the helmet. The chin straps 48 are inwardly extended through insertion holes 50 formed in the supporting plates 47.

A description will now be made of the operation of this embodiment.

When mounting the inner pad 24 to the cap body 1, the first mounting plate 29 is urged forwardly in a state where the plate 29 is superposed on the first supporting plate 14 so that the recesses 35 are set at positions corresponding to the locking portions 33. Then, the first mounting plate 29 is guided from the separating position to the engaging position at a predetermined engaging position by means of the guide means G. The locking protrusions 33 are urged to enter between the engaging portions 32 and the first supporting plate 14. The locking protrusions 33 are elastically engaged with the pawls 34, and the first mounting plate 29 is engaged with the first supporting plate 14 by means of the first locking means $E_1$. The pair of insertion portions 30 are inserted between the buffer liner 3 and the shell 2 in the engaging state of the first locking means $E_1$ as described above. The pair of holding portions 31 are inserted between the ear pads 46 and the buffer liner 3, thereby fixedly securing the front portion of the inner pad 24 to a predetermined position of the cap body 1. Then, the rear end of the inner pad 24 is engaged with the rear end of the cap body 1 by the second locking means $E_2$ thereby to complete mounting of the inner pad 24 to the cap body 1. Thus, the mounting operation is extremely easy.

In the mounting operation of the inner pad 24 to the cap body 1 as described above, the first mounting plate 29 is guided by the guide means G and is engaged with the first supporting plate 14 by means of the first locking means $E_1$ at the predetermined engaging position. Therefore, the mounting position of the inner pad 24 to the cap body 1 is easily determined.

When a user wearing a cap body 1 with the inner pad 24 mounted thereto is travelling on a motorcycle, if the air intake holes 8 of the front end of the cap body 1 are opened, a travelling wind is introduced from the air intake holes 8 into the front ventilation grooves 6a. A part of the introduced air is sucked out from the air discharge holes 11 through the guide holes 41, the ventilation grooves 40, the guide holes 42 and the rear ventilation grooves 6b to efficiently ventilate the interior of the cap body 1.

If the wearer of the helmet is in a stooped position with the wearer's head down in a state where the shield plate 9 is located at its closed position, indicated by a solid line in FIG. 1 at the time of travelling on a motorcycle, a travelling wind is scarcely introduced inside the shield plate 19. A part of the air introduced from the air intake holes 8 into the cap body 1 is spouted out toward the inner surface of the shield plate 19 from the plurality of diffusers 37 through the communication grooves 17, the communication holes 16 and the passages 38. Inside the shield plate 19, a negative air pressure is generated at the lower portion of the shield plate 19 when the wearer of the helmet is travelling on a motorcycle in a stooped attitude, and the air spouted out from the diffusers 37 is sucked out by the acting of the negative air pressure and flows downwardly along the inner surface of the shield plate 19. Therefore, the cloud on the shield plate 19 caused by the breath of the wearer of the helmet can be reliably prevented.

What is claimed is:

1. A jet type helmet comprising:

a cap body with a window defined in a front thereof, a lower portion of the window being opened at a lower open edge of the cap body;

a shield plate supported at opposite sidewalls of the cap body and capable of covering the window;

an air intake hole provided in a front wall of the cap body above the window for introducing air from a forward direction into the cap body when the window is covered by the shield plate;

a ventilation groove extending longitudinally in an inner surface of the cap body so as to reach an edge of the window and communicating with the air intake hole;

a mounting plate, disposed at the edge of the window, attaching a pad on the inner surface of the cap body; and a diffuser formed on said mounting plate and communicated with the ventilation groove, said diffuser having an opening directed toward an inner surface of the shield plate in a state where the shield plate is at a position covering the window.

2. A jet type helmet according to claim 1, wherein said mounting plate is formed with a box-shaped protrusion having a hollow interior and protruded downwardly from the edge of said window so as to increase an amount of protrusion on a front side of the helmet and communicating the hollow interior with said ventilation groove, and said diffuser being perforated at a front wall of said protrusion.

3. A jet type helmet according to claim 2, wherein said cap body is provided with a vent hole opened at a bottom surface of said ventilation groove to communicate with said air intake hole, an open surface of said ventilation groove being closed by a cover plate superposed on the inner surface of said cap body along an upper part of the edge of the window to prevent said inner pad from entering the ventilation groove.

* * * * *